US010641231B2

(12) United States Patent
Kondo

(10) Patent No.: US 10,641,231 B2
(45) Date of Patent: May 5, 2020

(54) IGNITION COIL FOR INTERNAL COMBUSTION ENGINE

(71) Applicant: DENSO CORPORATION, Kariya, Aichi-pref. (JP)

(72) Inventor: Yuki Kondo, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/203,990

(22) Filed: Nov. 29, 2018

(65) Prior Publication Data

US 2019/0162156 A1 May 30, 2019

(30) Foreign Application Priority Data

Nov. 30, 2017 (JP) ..... 2017-230848

(51) Int. Cl.

| | |
|---|---|
| ***F02P 3/02*** | (2006.01) |
| ***F02P 3/055*** | (2006.01) |
| ***F02P 9/00*** | (2006.01) |
| ***H01F 38/12*** | (2006.01) |
| ***F02P 13/00*** | (2006.01) |
| *H01F 27/30* | (2006.01) |
| *H01F 27/02* | (2006.01) |

(52) U.S. Cl.

CPC ..... *F02P 3/055* (2013.01); *F02P 9/002* (2013.01); *F02P 13/00* (2013.01); *H01F 38/12* (2013.01); *H01F 27/022* (2013.01); *H01F 27/306* (2013.01)

(58) Field of Classification Search

CPC .... F02P 3/02; F02P 3/055; F02P 9/002; F02P 13/00; H01F 38/12; H01F 27/022; H01F 27/306

USPC ..... 123/635, 647, 169 PA

See application file for complete search history.

(56) References Cited

U.S. PATENT DOCUMENTS

| | | | | |
|---|---|---|---|---|
| 9,548,156 | B2 * | 1/2017 | Kawai | H01F 38/12 |
| 10,431,376 | B2 * | 10/2019 | Kawai | H01F 27/40 |
| 2017/0321648 | A1 | 11/2017 | Sano et al. | |

* cited by examiner

*Primary Examiner* — Hai H Huynh

(74) *Attorney, Agent, or Firm* — Nixon & Vanderhye P.C.

(57) ABSTRACT

An ignition coil has primary and secondary coils, a coil casing having a casing body, an accommodating part and a high voltage tower shaped part of a cylindrical shape, a resistance member arranged as a movable member in a tower through hole of the high voltage tower, a high voltage cap, and an insulation resin member with which the accommodating part is filled. A proximal end part of the tower through hole has an inner diameter which is greater than an outer diameter of a maximum outer diameter part of the resistance member. A distal end part of the tower through hole has an inner diameter which is less than the outer diameter of the maximum outer diameter part of the resistance member. A vent part is formed, through which the proximal end part of the tower through hole communicates with the distal end part of the tower through hole.

10 Claims, 15 Drawing Sheets

FIRST MODIFICATION
3
71
71
31
35

SECOND MODIFICATION
71
71
31
35

THIRD MODIFICATION
71
31
35

FOURTH MODIFICATION
71
35
71
31

FIFTH MODIFICATION
71
35
71
31

1
C
2
3
D
6
5
C
C (ARROW LINE D)
21
W
G
C (C–C)
71
3
W
35
W
35
71

(COMPARATIVE EXAMPLE)

(COMPARATIVE EXAMPLE)

SIXTH MODIFICATION

SEVENTH MODIFICATION

EIGHTH MODIFICATION

NINTH MODIFICATION

TENTH MODIFICATION

ELEVENTH MODIFICATION

IGNITION COIL FOR INTERNAL COMBUSTION ENGINE

CROSS-REFERENCE TO RELATED APPLICATION

This application is related to and claims priority from Japanese Patent Application No. 2017-230848 filed on Nov. 30, 2017, the contents of which are hereby incorporated by reference.

BACKGROUND OF THE INVENTION

1. Field of the Invention

The present invention relates to ignition coils to be mounted on ignition devices of internal combustion engines.

2. Description of the Related Art

In an ignition device for an internal combustion engine, an ignition coil generates a high voltage, and supplies the generated high voltage to a spark plug so as to generate an electric spark. In general, such an ignition coil has a primary coil, a secondary coil, and an outer peripheral core. The primary coil and the secondary coil are concentrically arranged around a central core, and the outer peripheral core is arranged outside of the primary coil and the secondary coil. The primary coil, the secondary coil and the outer peripheral core are accommodated in a coil casing made of resin, and sealed completely with insulation resin such as epoxy resin. A high voltage tower shaped part is formed to project from the coil casing, through which the primary coil and the secondary coil are electrically connected to the spark plug.

For example, patent document 1, Japanese patent laid open publication No. 2016-092363 shows a coil casing for accommodating an ignition coil having a structure in which a tower shaped through hole is formed in a high voltage tower shaped part along an axial direction thereof, and is open to an accommodating part which accommodates the primary coil and the secondary coil. The opening end part of the tower shaped through hole is sealed with a high voltage cap. A resistance member and a coil spring are accommodated in the tower shaped through hole. The resistance member is in contact with the high voltage cap by a spring force of the coil spring. A high voltage terminal of the secondary coil is electrically connected to the resistance member.

A distal end part of the tower shaped through hole is open, through which the coil spring is inserted into the inside of the tower shaped through hole. In a state in which no coil spring is inserted, the tower shaped through hole prevents the resistance member from moving to the outside of the tower shaped through hole because the tower shaped through hole has a diameter reducing part, a diameter of which is gradually reduced toward the distal end part of the tower shaped through hole.

In production of the ignition coil having the structure previously described, the resistance member is inserted into and accommodated in the tower shaped through hole of the high voltage tower shaped part. The high voltage cap is fitted with the opening end part of the tower shaped through hole. An assemble member composed of the primary coil and the secondary coil, etc. is accommodated in the accommodating part. After this, resin is inserted into the inside of the coil casing and hardened so as to seal the assemble member composed of the primary coil and the secondary coil, etc. with the resin. The assemble member is fixed into the col casing. However, in production, when air is sucked out from the inside of the tower shaped through hole of the high voltage tower shaped part during the resin supply step, the resistance member is fitted to the diameter reducing part of the tower shaped through hole by air suction force. When the inserting side of the tower shaped through hole is closed by the resistance member, a pressure of the inside air (hereinafter, the inside air pressure) in the tower shaped through hole increases by air expansion, and the increased inside air pressure pushes up the high voltage cap. As a result, when a gap is formed between the opening end part of the tower shaped through hole and the high voltage cap during the resin supply step in production of the ignition coil, the inserted resin leaks into the inside of the tower shaped through hole through the generated gap.

SUMMARY

It is therefore desired to provide an ignition coil for an internal combustion engine having a high voltage tower shaped part capable of suppressing an internal pressure of a tower through hole in the high voltage tower shaped part from increasing and of preventing leakage of resin, etc. into the inside of the tower through hole due to movement of a high voltage cap fitted to a proximal end part of the tower through hole during a resin sealing step in production of the ignition coil.

In accordance with one aspect of the present invention, there is provided an ignition coil having a primary coil, a secondary coil, a coil casing, a resistance member, a high voltage cap and an insulation resin member. The coil casing has a casing body, an accommodating part formed in the casing body and a high voltage tower shaped part having a cylindrical shape. The accommodating part accommodates the primary coil and the secondary coil. The high voltage tower shaped part is formed projecting toward the outside of the casing body. A proximal end part of the high voltage tower shaped part is arranged in contact with a bottom surface of the accommodating part. A tower through hole is formed in the high voltage tower shaped part. The resistance member has a cylindrical shape arranged as a movable member in the tower through hole. The high voltage cap is arranged at the proximal end part of the high voltage tower shaped part so as to prevent communication between the tower through hole and the accommodating part. The high voltage cap electrically connects the resistance member with a high voltage terminal connected to the secondary coil. The accommodating part is filled with the insulation resin member. In the ignition coil, a proximal end part of the tower through hole has an inner diameter which is greater than an outer diameter of a maximum outer diameter part of the resistance member. A distal end part of the tower through hole has an inner diameter which is less than the outer diameter of the maximum outer diameter part of the resistance member. One or more vent parts are formed in the tower through hole of the inside of the high voltage tower shaped part when the resistance member is arranged at a maximum distal end position in the tower through hole. The proximal end part of the tower through hole communicates with the distal end part of the tower through hole through the vent parts.

In the improved structure of the ignition coil according to the present invention, when the resistance member moves to the distal end part of the tower through hole of the high voltage tower shaped part and locates at the distal end position of the tower through hole, the inside air in the tower through hole communicates with the outside of the high voltage tower shaped part through the vent parts because the gap at the proximal end part of the tower through hole communicates with the gap at distal end part of the tower through hole through the vent parts. this structure makes it possible to discharge the inside air of the proximal end part to the outside of the distal end part of the tower through hole during the resin sealing process performed under a reduced pressure environment such as several hundred pascals. The accommodating part in the coil casing is filled with the resin composition by the resin sealing process. Because this structure makes it possible to suppress the internal pressure at the proximal end part of the tower through hole from increasing during the suction step of the resin sealing process. It is therefore possible to prevent the high voltage cap from coming out from the tower through hole, to prevent the gap from being generated due to the coming out of the high voltage cap during a suction step in the resin sealing process, and to prevent the resin injected by the resin injection step from being leaked into the inside of the tower through hole in the high voltage tower shaped part during the resin sealing process.

As previously described, the improved structure of the ignition coil according to the present invention makes it possible to suppress the internal pressure of the tower through hole of the high voltage tower shaped part from increasing, and to suppress defects such as leakage of injected resin from occurring due to the coming out of the high voltage cap during the suction step in the resin sealing process. It is therefore possible for the present invention to provide the ignition coil having the improved structure and effects for internal combustion engines.

BRIEF DESCRIPTION OF THE DRAWINGS

A preferred, non-limiting embodiment of the present invention will be described by way of example with reference to the accompanying drawings, in which.

DETAILED DESCRIPTION OF THE PREFERRED EMBODIMENTS

Figure 1:
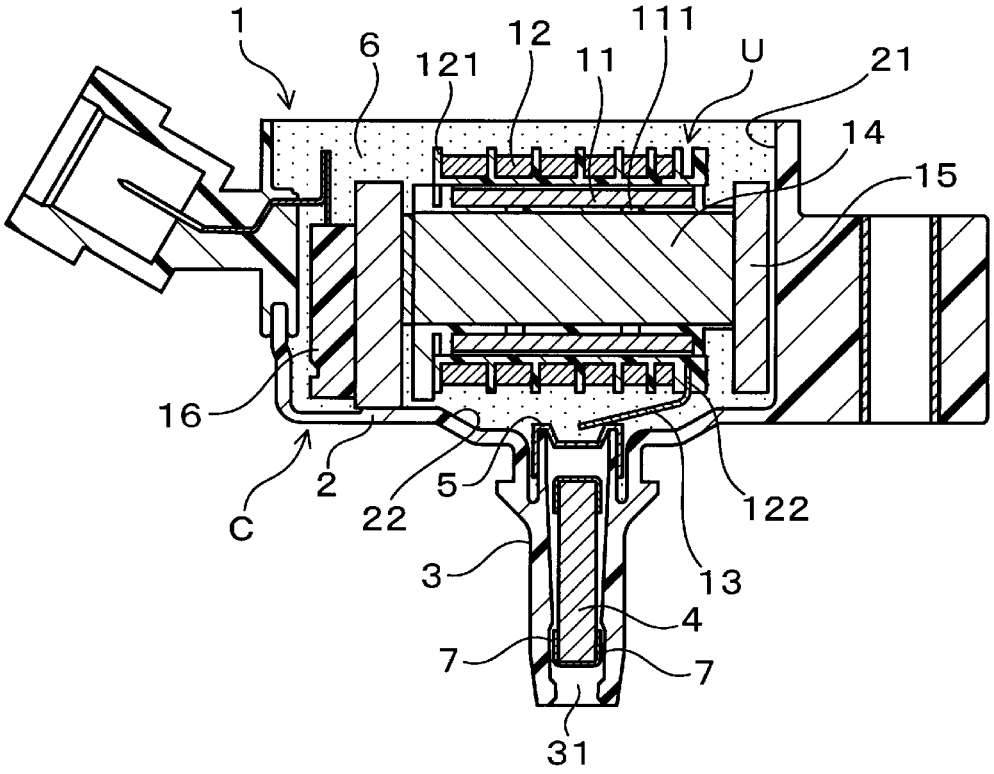
FIG. 1 is a view showing a cross section of an ignition coil for an internal combustion engine according to a first exemplary embodiment of the present invention.

Hereinafter, various embodiments of the present invention will be described with reference to the accompanying drawings. In the following description of the various embodiments, like reference characters or numerals designate like or equivalent component parts throughout the several diagrams.

First Exemplary Embodiment

A description will be given of an ignition coil 1 a for an internal combustion engine according to the first exemplary embodiment of the present invention with reference to FIG. 1 to FIG. 13.

Figure 2:
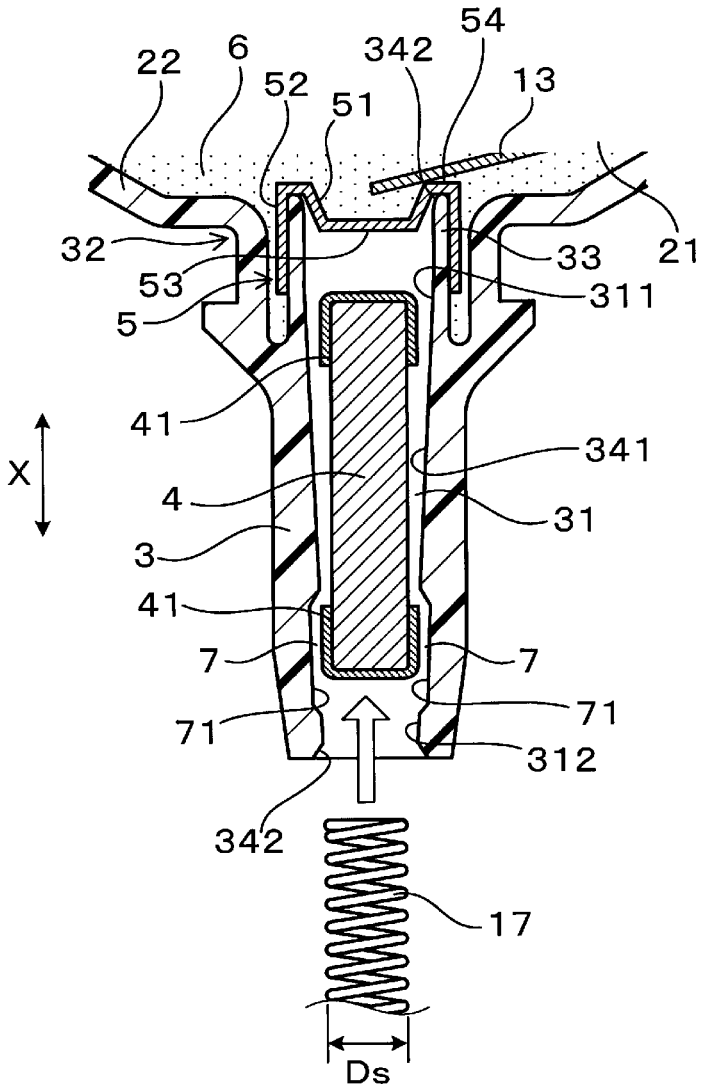
FIG. 2 is a part enlarged view showing a cross section of the ignition coil for an internal combustion engine according to the first exemplary embodiment so as to assemble a coil spring with a tower through hole.

FIG. 1 is a view showing a cross section of the ignition coil 1 for an internal combustion engine according to the first exemplary embodiment of the present invention. FIG. 2 is a part enlarged view showing a cross section of the ignition coil 1 according to the first exemplary embodiment so as to assemble a coil spring 17 with a tower through hole 31.

As shown in FIG. 1 and FIG. 2, the ignition coil 1 according to the first exemplary embodiment has a primary coil 11, a secondary coil 12, a coil casing C, a resistance member 4 having a cylindrical shape, a high voltage cap 5 and an insulation resin member 6. The coil casing C has a casing body 2, an accommodating part 21 formed in the casing body 2 and a high voltage tower shaped part 3 having a cylindrical shape. The high voltage tower shaped part 3 projects toward the outside of the casing body 2. The tower through hole 31 is formed in the inside of the high voltage tower shaped part 3. The resistance member 4 is arranged as a movable member in the inside of the tower through hole 31. The insulation resin member 6 is fitted in the inside of the accommodating part 21.

As shown in FIG. 1, the accommodating part 21 of the coil casing C accommodates the primary coil 11 and the secondary coil 12. As shown in FIG. 2, the high voltage tower shaped part 3 is arranged so that a proximal end part of the high voltage tower shaped part 3 is arranged to be in contact with a bottom surface 22 of the accommodating part 21. The high voltage cap 5 is attached to the proximal end part of the high voltage tower shaped part 3. The high voltage cap 5 prevents the accommodating part 21 from communicating with the tower through hole 31 in the high voltage tower shaped part 3. The high voltage cap 5 electrically connects the resistance member 4 to a high voltage terminal 13 connected to the secondary coil 12.

As shown in FIG. 2, the tower through hole 31 has a proximal end part 311 and a distal end part 312. The proximal end part 311 of the tower through hole 31 has an inner diameter t1 (see FIG. 3A, which will be explained in detail later) which is greater than an outer diameter Dr (see FIG. 3A, which will be explained in detail later) having a maximum outer diameter of the resistance member 4. Further, the distal end part 312 of the tower through hole 31 has an inner diameter dt2 (see FIG. 3A, which will be explained in detail later) which is less than the outer diameter Dr of the maximum outer diameter part of the resistance member 4.

Still further, as shown in FIG. 2, a vent part 7 is formed on an inner surface of the high voltage tower shaped part 3. Through the vent part 7, the proximal end part 311 of the tower through hole 31 communicates with the distal end part 312 of the tower through hole 31 when the resistance member 4 is arranged at a maximum distal end position in the tower through hole 31. A detailed structure of the tower through hole 31 will be explained later.

As shown in FIG. 1, the ignition coil 1 according to the first exemplary embodiment is applied to automotive engines as internal combustion engines, for example. The ignition coil 1 according to the first exemplary embodiment supplies a high voltage to ignition plugs mounted on an internal combustion engine. The ignition coil 1 is arranged into a plug hole formed in a cylinder head (not shown) of the internal combustion engine. The coil casing C has the casing body 2 and the high voltage tower shaped part 3. The casing body 2 is arranged outside of the plug hole of the cylinder head of the internal combustion engine. The high voltage tower shaped part 3 is connected to the ignition plug in the plug hole of the cylinder head. The casing body 2 has a rectangle shape, a top part thereof is open. The accommodating part 21 is formed in the inside of the casing body 2.

The high voltage tower shaped part 3 having a cylindrical shape is assembled with the casing body 2 together. The high voltage tower shaped part 3 is arranged to project toward a direction away from the location of the accommodating part 21.

The primary coil 11 and the secondary coil 12 are arranged in an axial direction of the accommodating part 21, which is parallel to the bottom surface 22 of the accommodating part 21, so that the primary coil 11 and the secondary coil 12 are overlapped concentrically together in inner circumference and outer circumference. A central core 14 is arranged at the inner circumference side of the primary coil 11 and the secondary coil 12. An outer core 15 is arranged at the outer radial side of the primary coil 11 and the secondary coil 12.

The primary coil 11 and the secondary coil 12, the central core 14 and the outer core 15 form a coil unit U.

As shown in FIG. 1, the primary coil 11 is wound on a primary spool 111 made of resin. The secondary coil 12 is wound on a secondary spool 121 made of resin. A high voltage terminal 13 is arranged on the secondary spool 121. The high voltage terminal 13 is connected to a high voltage winding end part 122 of the secondary spool 121. The high voltage terminal 13 is arranged to be in contact with the high voltage cap 5. The central core 14 and the outer core 15 are made of soft magnetic material and form a closed magnetic path, through which magnetic flux passes.

An ignitor 16 is arranged at the coil unit U in the accommodating part 21 of the coil casing C. The ignitor 16 has a switching element which allows the primary coil 11 to receive electric power and prohibits the primary coil 11 from receiving electric power.

The accommodating part 21 accommodating the coil unit U, etc. is filled with an insulation resin 6 so as to electrically insulate the coil unit U having the primary coil 11 and the secondary coil 12 from other components. For example, epoxy resin is used as the insulation resin 6.

As shown in FIG. 1 and FIG. 2, a recess part or a depressed part is formed on a part of the bottom surface 22, which face the coil unit U side, of the accommodating part 21. The high voltage tower shaped part 3 has a cylindrical shape and is connected at a central area of the recess part so that the high voltage tower shaped part 3 is arranged below the bottom surface 22 of the coil casing C in an axial direction X of the high voltage tower shaped part 3. That is, the high voltage tower shaped part 3 is arranged in the axial direction X which is perpendicular to the axial direction of the primary coil 11 and the secondary coil 12. The coil casing C having the casing body 2 and the high voltage tower shaped part 3 is made of insulation resin such as polybutylene terephthalate (PBT).

As shown in FIG. 2, the high voltage tower shaped part 3 of the coil casing C has the tower through hole 31. Both end parts of the tower through hole 31 are open. The distal end part 312 (see the bottom side shown in FIG. 2) of the tower through hole 31 is open in the axis direction X toward the outside of the ignition coil 1. The proximal end part 311 (see the upper side shown in FIG. 2) of the tower through hole 31 is open and facing the bottom surface 22 of the accommodating part 21 of the coil casing C. The high voltage tower shaped part 3 has a double cylindrical structure at a connection part 32 formed between the tower through hole 31 and the accommodating part 21 of the coil casing C. That is, the high voltage tower shaped part 3 has a double cylindrical structure having an inner cylindrical part 33 and an outer cylindrical part. The inner cylindrical part 33 of the high voltage tower shaped part 3 projects into the inside of the accommodating part 21 of the coil casing C. The high voltage cap 5 is fitted to the inner cylindrical part 33.

As shown in FIG. 2, the high voltage cap 5 is composed of a central disk-shape part 51 and an outer peripheral cylindrical part 52 around the central disk-shape part 51. The proximal end part 311 of the inner cylindrical part 33 of the high voltage tower shaped part 3 is covered with the high voltage cap 5 so as to close the proximal end part 311 of the tower through hole 31. The central disk-shape part 51 of the high voltage cap 5 has a recess shape or depressed shape toward the inside of the tower through hole 31 so as to form a disk-shape contact part 53. That is, the disk-shape contact part 53 of the high voltage cap 5 is formed, which faces the resistance member 4 and is in contact with the resistance member 4 because the resistance member 4 is a movable body. A ring-shape projecting part of the high voltage cap 5 forms a contact part 54 which is in contact with the high voltage terminal 13 shown in FIG. 2. For example, the high voltage cap 5 is made of a metal member such as Iron (Fe), Copper (Cu) and Aluminum (Al). That is, the high voltage cap 5 is produced by pressing and bending a metal member.

As shown in FIG. 2, a coil spring 17 is inserted into the distal end part 312 of the tower through hole 31. The resistance member 4 is pushed toward the upward in the tower through hole 31 by the spring force of the coil spring 17. The resistance member 4 is forcedly in contact with the disk-shape contact part 53 of the high voltage cap 5 by the spring force of the coil spring 17. This makes it possible to form the electrically connection between the resistance member 4 and the high voltage terminal 13 connected to the secondary coil 12.

The resistance member 4 is made of a conductive ceramics or a winding and has a cylindrical shape and a cross section of the resistance member 4 is a circular shape. Conductive caps 41 are fitted to the respective end parts of the resistance member 4. The conductive caps 41 have the same outer diameter. The conductive caps 41 are fitted on the respective maximum outer diameter parts at both the end parts of the resistance member 4. As shown in FIG. 1 and FIG. 2, because the conductive cap 41 has been fitted to the distal end part of the resistance member 4, the distal end part with the conductive cap 41 has the maximum outer diameter in the resistance member 4.

Similar to the high voltage cap 5 previously described, each of the conductive caps 41 is made of metal member such as Iron (Fe), Copper (Cu) and Aluminum (Al).

A tapered hole part 341 is formed as the tower through hole 31 in the high voltage tower shaped part 3. A diameter of the tapered hole part 321 is gradually reduced from the proximal end part to the distal end part of the tower through hole 31. Cut parts 342 are formed at the respective opening part at the distal end part and the respective opening part at the proximal end part of the tower through hole 31. A proximal end part of the tapered hole part 341 forms the proximal end part 311 of the tower through hole 31. A distal end part of the tapered hole part 341 forms the distal end part 312 of the tower through hole 31.

Figure 3A:
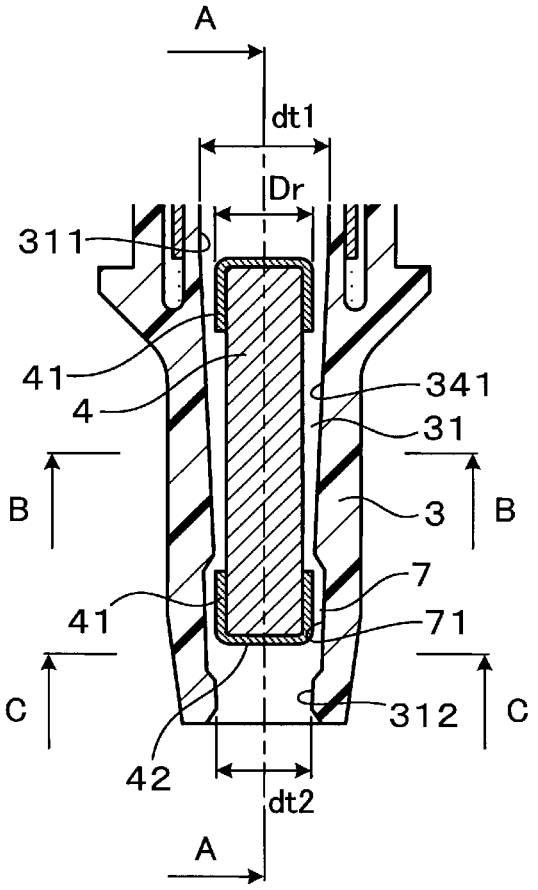
FIG. 3A is a view showing an enlarged cross section of a high voltage tower shaped part in the ignition coil for an internal combustion engine according to the first exemplary embodiment shown in FIG. 1.
Figure 3B:
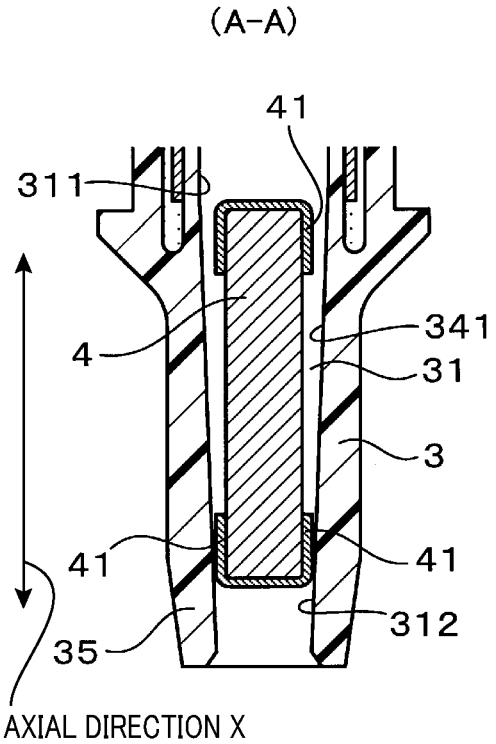
FIG. 3B is a view showing a cross section of the high voltage tower shaped part along the arrow line A-A shown in FIG. 3A.
Figure 3C:
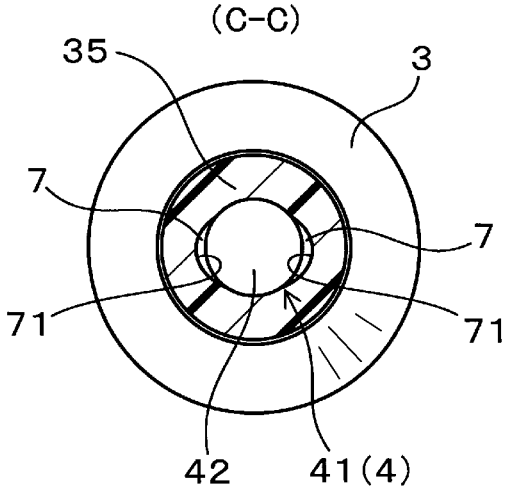
FIG. 3C is a view showing a cross section of the high voltage tower shaped part along the arrow line C-C shown in FIG. 3A.
Figure 3D:
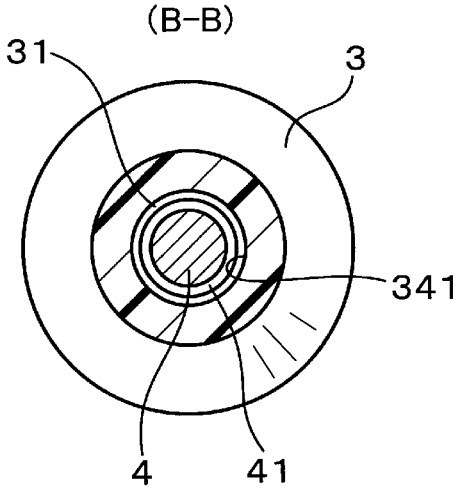
FIG. 3D is a view showing a cross section of the high voltage tower shaped part along the arrow line B-B shown in FIG. 3A.

FIG. 3A is a view showing an enlarged cross section of the high voltage tower shaped part 3 in the ignition coil 1 according to the first exemplary embodiment. FIG. 3B is a view showing a cross section of the high voltage tower shaped part 3 along the arrow line A-A shown in FIG. 3A. FIG. 3C is a view showing a cross section of the high voltage tower shaped part 3 along the arrow line C-C shown in FIG. 3A. FIG. 3D is a view showing a cross section of the high voltage tower shaped part 3 along the arrow line B-B shown in FIG. 3A.

As shown in FIG. 3A, the high voltage tower shaped part 3 has the structure in which the inner diameter dt1 of the proximal end part 311 of the tower through hole 31 is greater than the outer diameter Dr of the maximum outer diameter part of the resistance member 4. Further, the distal end part 312 of the tower through hole 31 has the inner diameter dt2 which is greater than the outer diameter Ds at the proximal end part of the coil spring 17, and is less than the outer diameter Dr of the maximum outer diameter part of the resistance member 4.

The inner diameter dt1, the inner diameter dt2, the outer diameter Dr and the outer diameter Ds previously described satisfy the following relationship:

$$Ds<dt2<Dr<dt1.$$

The structure of the tower through hole 31 and the resistance member 4 makes it possible to allow the resistance member 4 to be smoothly inserted and accommodated in the inside of the tower through hole 31 and to make a gap between the resistance member 4 and the tapered hole part 341 as the tower through hole 31. When the coil spring 17 is inserted into and arranged in the tower through hole 31, the resistance member 4 becomes a movable body in the axial direction X of the tower through hole 31 of the high voltage tower shaped part 3.

As shown in FIG. 3B, when the coil spring 17 (see FIG. 2) is detached from the inside of the tower through hole 31, the formation of the distal end part 312 in the tower through hole 31 prevents the resistance member 4 from coming out from the tower through hole 31 to the outside because the outer diameter Dr of the maximum diameter part of the resistance member 4 is greater than the inner diameter dt2 of the distal end part 312 of the tower through hole 31.

As shown in FIG. 3A, the vent part 7 is formed on the inner surface of the high voltage tower shaped part 3. Through the vent part 7, the proximal end part 311 of the tower through hole 31 communicates with the distal end part 312 of the tower through hole 31 when the resistance member 4 is located at the maximum distal end position (i.e. the maximum bottom side) of the tower through hole 31.

In the structure of the coil spring 1 according to the first exemplary embodiment, the vent part 7 is formed as an inner peripheral groove 71 (hereinafter, the groove 71) along the axial direction X on the inner peripheral surface of the tapered hole part 341 as the tower through hole 31 in the high voltage tower shaped part 3. That is, a gap is formed as the vent part 7 between the resistance member 4 and the groove 71.

For example, the groove 71 is formed on the inner peripheral surface of the tapered hole part 341 as the tower through hole 31 in the high voltage tower shaped part 3 so that the groove 71 has a length which is greater in the axial direction X than a length of the conductive cap 41 which has been fitted to the distal end part having the maximum outer diameter of the resistance member 4. Because the conductive cap 41 (see FIG. 3A) has been fitted to the distal end part of the resistance member 4, the distal end part with the conductive cap 41 has the maximum outer diameter in the resistance member 4.

That is, as clearly shown in FIG. 1, FIG. 2 and FIG. 3A, in the axial direction X, the location of the distal end part of the groove 71 projects more than the location of the distal end surface 42 of the conductive cap 41. Further, in the axial direction X, the location of the proximal end part of the groove 71 projects more than the location of the proximal end part of the conductive cap 41 fitted to the distal end part having the maximum outer diameter of the resistance member 4.

In more detail, as shown in FIG. 3C, a pair of the grooves 71 are formed at two locations, respectively on the inner peripheral surface of the tower through hole 31 (or the tapered hole part 341) in the high voltage tower shaped part 3 so that the grooves 71 face from each other on the inner peripheral surface of the tower through hole 31.

That is, each of the grooves 71 has an arc-shaped outline when viewed in a direction which is perpendicular to the axial direction X, and is smoothly in contact with an outer peripheral surface of the resistance member 4. In other words, the vent part 7 is formed between each of the grooves 71 and the outer peripheral surface of the resistance member with the conductive cap 41, and the formed vent part 7 has a cross section of an arc shape which is perpendicular to the axial direction X.

As shown in FIG. 3D, FIG. 3B and FIG. 3A, the proximal end part 311 of the tapered hole part 341 has an inner diameter which is greater than the outer diameter of the resistance member 4 so as to form the ring shaped gap as the tower through hole 31 between the proximal end part 311 of the tapered hole part 341 and the resistance member 4.

The concept of the present invention is not limited by the structure of the ignition coil 1 according to the first exemplary embodiment previously described. For example, it is possible for the ignition coil 1 to have various modifications. For example, instead of using the arc-shaped cross section (see FIG. 3C), it is acceptable for each of the grooves 71 to have a structure having a constant width and a constant depth, where the constant width is measured in a lateral direction which is perpendicular to the axial direction X, and the constant depth is measured in the axial direction X.

Figures 4A, 4B, 4C, 4D, 4E:
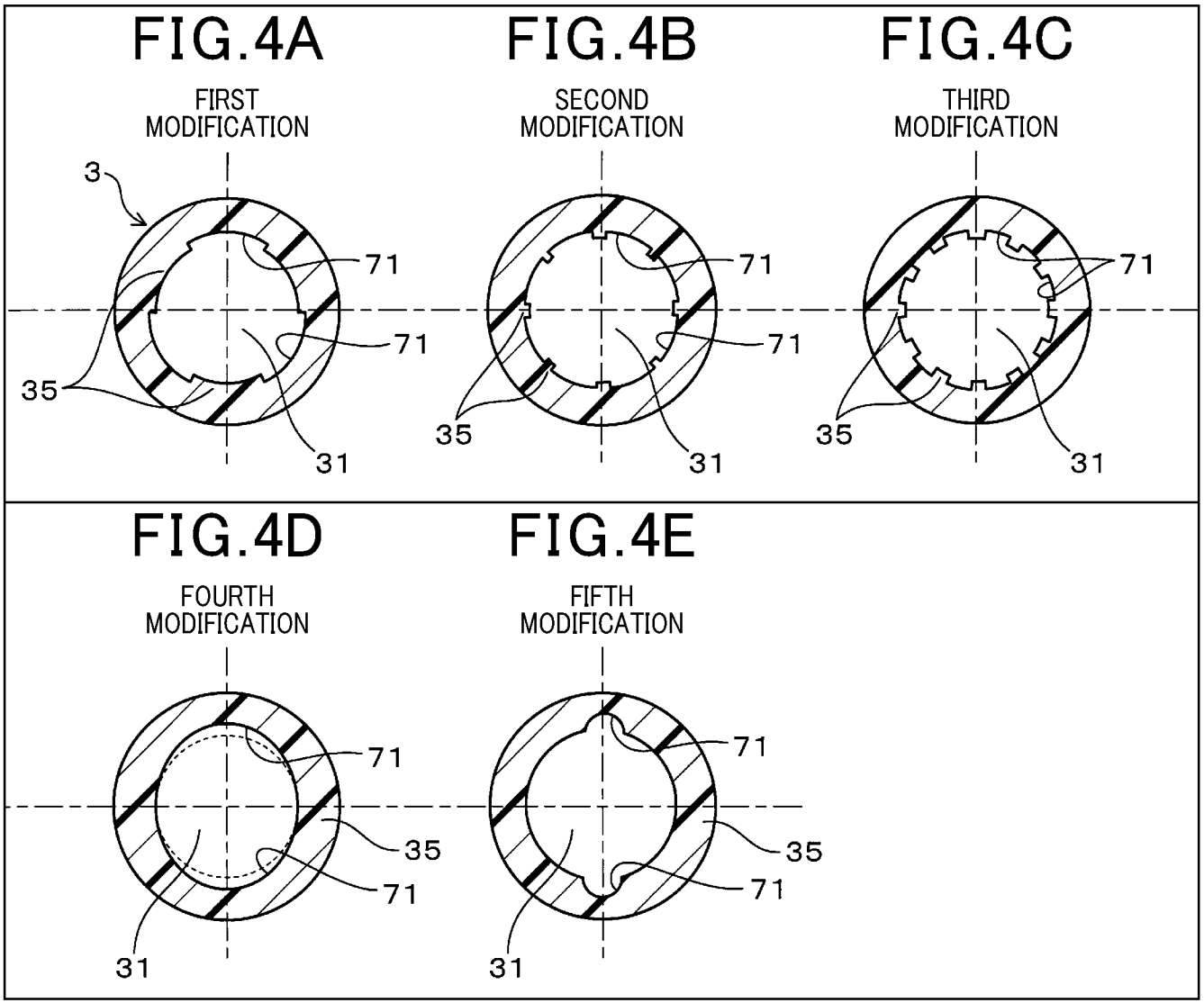
FIG. 4A is a view showing a cross section of three grooves as the vent parts having a shape according to a first modification, formed at the inner peripheral surface of the high voltage tower shaped part of the ignition coil according to the first exemplary embodiment of the present invention.
FIG. 4B is a view showing a cross section of eighth grooves as the vent parts having a shape according to a second modification, formed at the inner peripheral surface of the high voltage tower shaped part of the ignition coil according to the first exemplary embodiment.
FIG. 4C is a view showing a cross section of twelfth grooves as the vent parts having a shape according to a third modification, formed at the inner peripheral surface of the high voltage tower shaped part of the ignition coil according to the first exemplary embodiment.
FIG. 4D is a view showing a cross section of grooves as the vent parts having a shape according to a fourth modification, formed at the inner peripheral surface of the high voltage tower shaped part of the ignition coil according to the first exemplary embodiment.
FIG. 4E is a view showing a cross section of grooves as the vent parts having a shape according to a fifth modification, formed at the inner peripheral surface of the high voltage tower shaped part of the ignition coil according to the first exemplary embodiment.

FIG. 4A is a view showing a cross section of the grooves 71 as the vent part 7 having a shape according to a first modification, formed at the inner peripheral surface of the high voltage tower shaped part 3 of the ignition coil 1 according to the first exemplary embodiment of the present invention. FIG. 4B is a view showing a cross section of the grooves 71 as the vent part 7 having a shape according to a second modification, formed at the inner peripheral surface of the high voltage tower shaped part 3 of the ignition coil 1 according to the first exemplary embodiment. FIG. 4C is a view showing a cross section of the grooves 71 as the vent part 7 having a shape according to a third modification, formed at the inner peripheral surface of the high voltage tower shaped part 3 of the ignition coil 1 according to the first exemplary embodiment.

As shown in FIG. 4A, FIG. 4B and FIG. 4C, it is acceptable for the high voltage tower shaped part 3 in the ignition coil 1 to have more than two grooves 71 (see FIG. 1 to FIG. 3A and FIG. 3C), for example, to have the three grooves 71 (see FIG. 4A), the eight grooves 71 (see FIG. 4B), or the eleven grooves 71 (see FIG. 4C), which are formed in symmetry on the inner peripheral surface of the high voltage tower shaped part 3.

As shown in FIG. 4A to FIG. 4C, thick parts 35 having a constant thickness are formed around the grooves 71 on the inner peripheral surface of the high voltage tower shaped part 3. It is possible to support the resistance member 4 by the thick parts 35 having a projecting shape formed around the grooves 71 on the inner peripheral surface of the high voltage tower shaped part 3.

FIG. 4D is a view showing a cross section of the grooves 71 as the vent parts having a shape according to a fourth modification, formed at the inner peripheral surface of the high voltage tower shaped part 3 of the ignition coil 1 according to the first exemplary embodiment.

As shown in FIG. 4D, it is acceptable for each of the grooves 71 to have a wide width in a circumferential direction when each of the grooves 71 has an arc-shaped outline. In the fourth modification shown in FIG. 4D, a cross section, which is perpendicular to the axial direction X, of the tower through hole 31 has an elliptical shape. The maximum diameter part of the resistance member 4 is in contact with a short diameter part of the elliptical shape of the tower through hole 31.

FIG. 4E is a view showing a cross section of the grooves 71 as the vent parts having a shape according to a fifth modification, formed at the inner peripheral surface of the high voltage tower shaped part 3 of the ignition coil 1 according to the first exemplary embodiment.

As shown in FIG. 4E according to the fifth modification, it is acceptable for each of the grooves 71 to have a semi-arc-shaped outline so that the vent parts 7 formed by the grooves 71 have a cross section of a semi-circular shape, which is perpendicular to the axial direction X.

It is possible for the grooves 71 to have various shapes and sizes so long as they satisfy the required air passing amount and strength.

In the structure of the ignition coil 1 according to the first exemplary embodiment previously described, because the resistance member 4 is supported by the tapered hole part 341 as the tower through hole 31, this structure makes it possible to prevent the resistance member from coming out from the tower through hole 31 to the outside before the coil spring 17 is assembled with the tower through hole 31. Further, it is possible to allow air to flow in the tower through hole 31 of the high voltage tower shaped part 3 through the vent parts 7 when the resistance member 4 moves to the distal end part of the tower through hole 31, and the conductive cap 41 is in contact with the inner peripheral surface of the tapered hole part 341. The improves the structure of the ignition coil 1 according to the first exemplary embodiment and makes it possible to prevent the high voltage cap 5 from rising up and problems from occurring due to the rising-up of the high voltage cap 5 during an insulation sealing step in production of the ignition coil 1.

A description will be given of the insulation sealing step in production of the ignition coil 1 according to the first exemplary embodiment with reference to FIG. 5 to FIG. 13.

Figure 5:
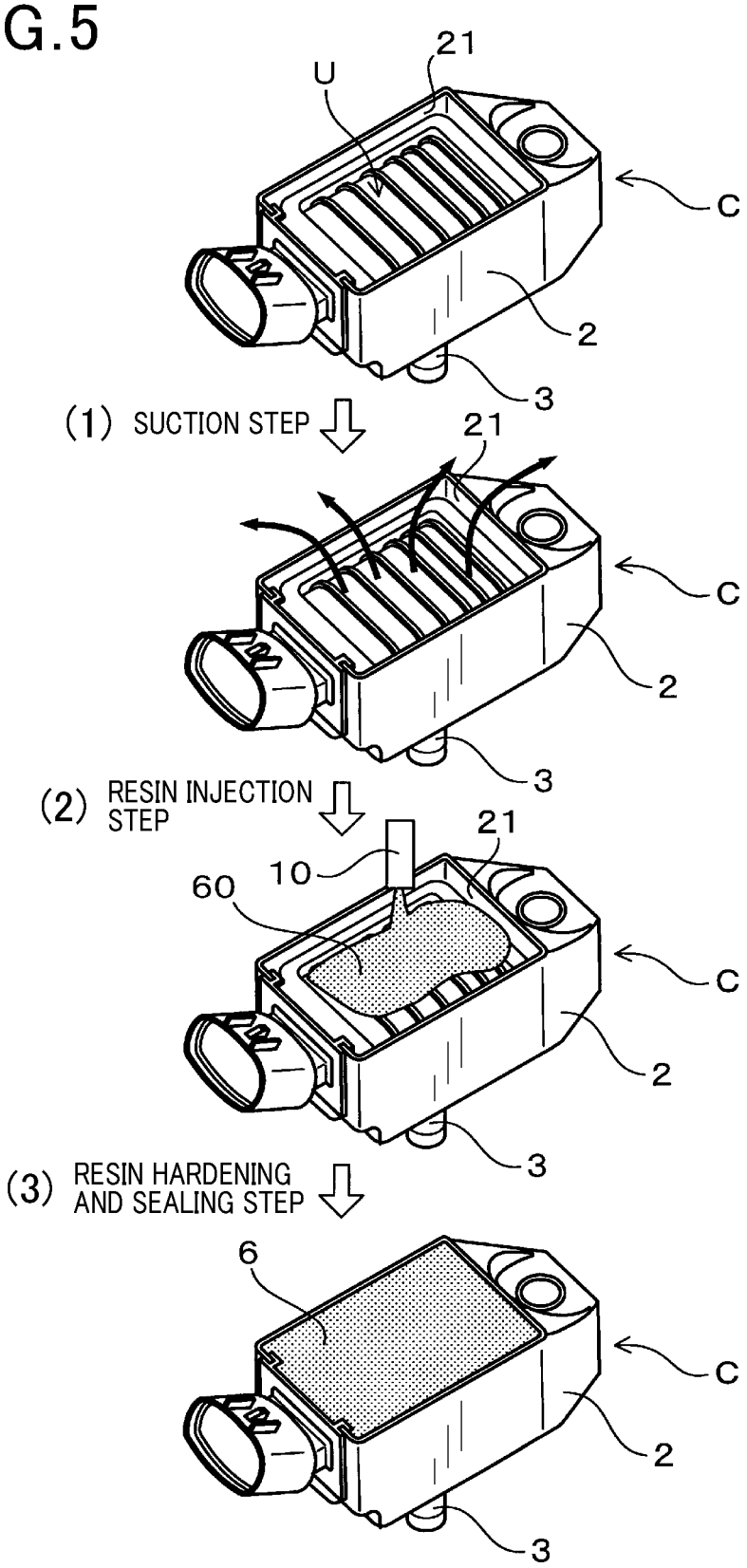
FIG. 5 is a view showing a resin sealing process in production of the ignition coil for an internal combustion engine according to the first exemplary embodiment of the present invention shown in FIG. 1.

FIG. 5 is a view showing a resin sealing process in production of the ignition coil 1 for an internal combustion engine according to the first exemplary embodiment of the present invention shown in FIG. 1.

It is possible to perform the insulation sealing step shown in FIG. 5 by using a molding device equipped with a suction pump device (or a vacuum pump, not shown), a pre-heating device (not shown) and a resin injection device (not shown).

Before performing a suction step (1) shown in FIG. 5, the casing body 2 has been produced by a molding shape step (not shown), the coil unit U having the primary coil 11 and the secondary coil 12 has been assembled into the casing body 2, and the casing body 2 and the high voltage tower shaped part 3 have been assembled into the coil casing C.

In the suction step (1) shown in FIG. 5, the coil casing C having the coil unit U is placed in the suction pump device (not shown). The suction pump device removes inside air from the coil casing C to approximately have a pressure of several hundred pascals (Pas).

In a resin injection step (2), resin composition 60 is injected into the inside of the accommodating part 21 of the coil casing C so as to produce the insulation resin 6 in the accommodating part 21. That is, the gap between the components in the coil unit U arranged in the coil casing C is filled with the resin composition.

In a resin hardening and sealing step (3), the resin composition 60 which has been injected in the accommodating part 21 is heated to harden the resin composition 60. This resin hardening and sealing step (3) makes it possible to completely seal the coil unit U with the resin composition 60 in the accommodating part 21 of the casing body 2 in the coil casing C.

Figures 6A, 6B:
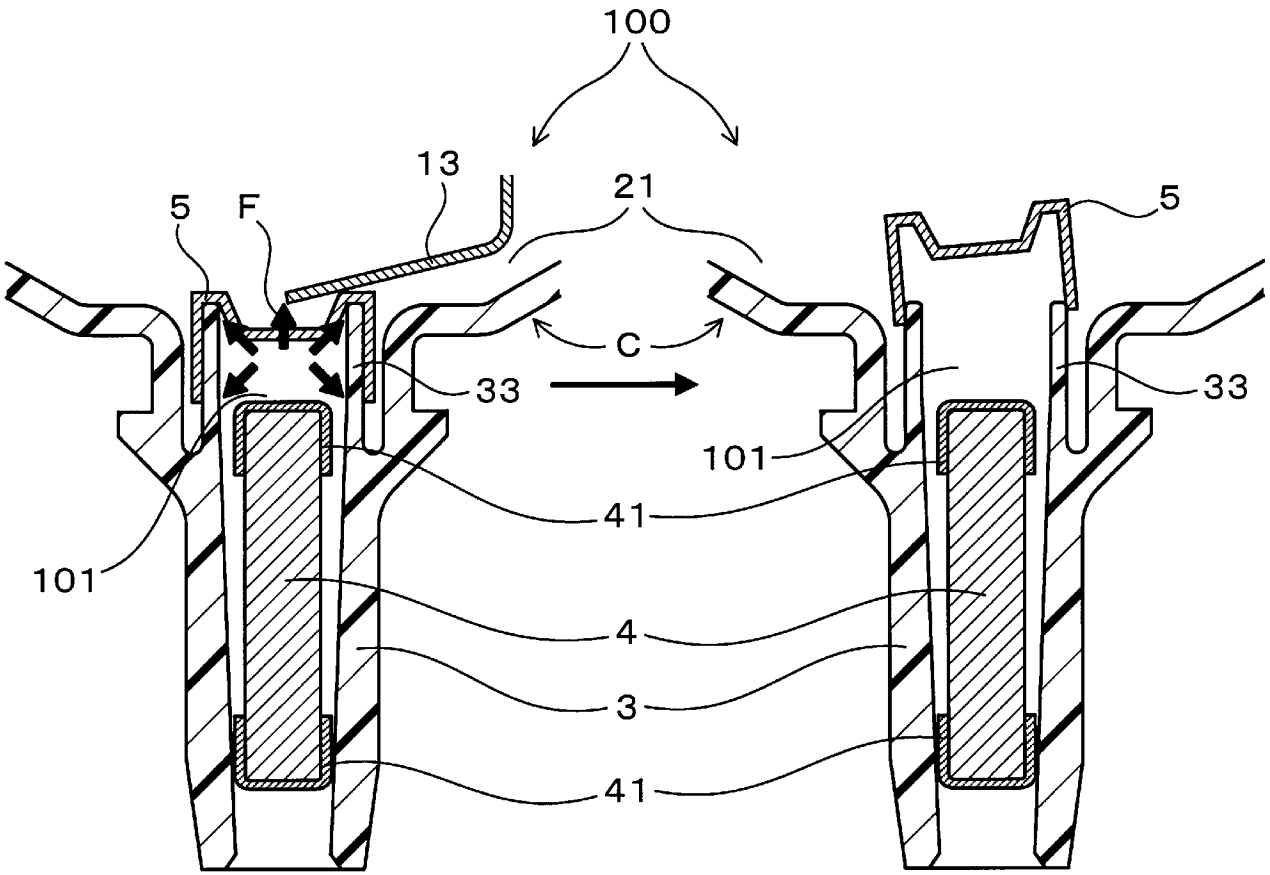
FIG.6A (RELATED ART)
FIG.6B (RELATED ART)
FIG. 6A and FIG. 6B are views showing an ignition coil according to related art having a conventional structure in which no vent part is formed in a high voltage tower shaped part.

FIG. 6A and FIG. 6B are views showing an ignition coil 100 according to a comparative sample as related art having a conventional structure in which no vent part is formed in a high voltage tower shaped part 101.

As shown in FIG. 6A and FIG. 6B, the ignition coil 100 does not have any vent part 7. In the structure of the ignition coil 100, the resistance member 4 is a movable body in the high voltage tower shaped part 101. When the maximum diameter part of the resistance member 4 is fitted and fixed to the inside of the small diameter part of the high voltage tower shaped part 101. In this case, the inside of the high voltage tower shaped part 101 is closed by the high voltage cap 5 and the resistance member 4 without any gap, and the inside of the high voltage tower shaped part 101 is maintained at the atmospheric pressure (i.e. at 1013 hPa). In this case, when performing the suction step (1) (see FIG. 5). The inside air of the high voltage tower shaped part 101 is expanded due to a pressure difference between the reduced pressure and the atmospheric pressure (i.e. at 1013 hPa) of the high voltage tower shaped part 101 because the inside of the high voltage tower shaped part 101 has been closed.

Figure 7:
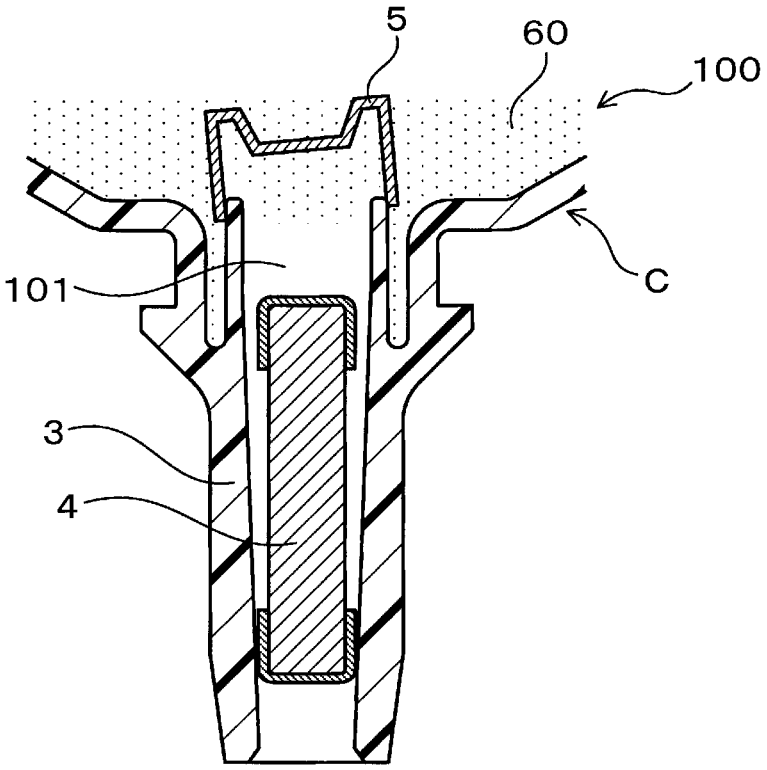
FIG.7 (RELATED ART)
FIG. 7 is a view showing occurrence of resin leakage into the high voltage tower shaped part in the high voltage tower shaped part in an ignition coil according to related art.

FIG. 7 is a view showing occurrence of resin leakage into the high voltage tower shaped part 101 in the high voltage tower shaped part 3 in the ignition coil 100 according to related art.

Because the expansion of the inside air of the high voltage tower shaped part 101 generates a force F (see the left view in FIG. 6), the generated force F pushes the high voltage cap 5 (see the right in FIG. 6), and the high voltage cap 5 is detached from the high voltage tower shaped part 3. In this case, as shown in FIG. 7, a part of the resin composition 60 injected by the resin injection step is leaked into the inside of the high voltage tower shaped part 101 through a gap. On the other hand, the improved structure of the ignition coil 1 according to the first exemplary embodiment can solve such drawback.

Figure 8:
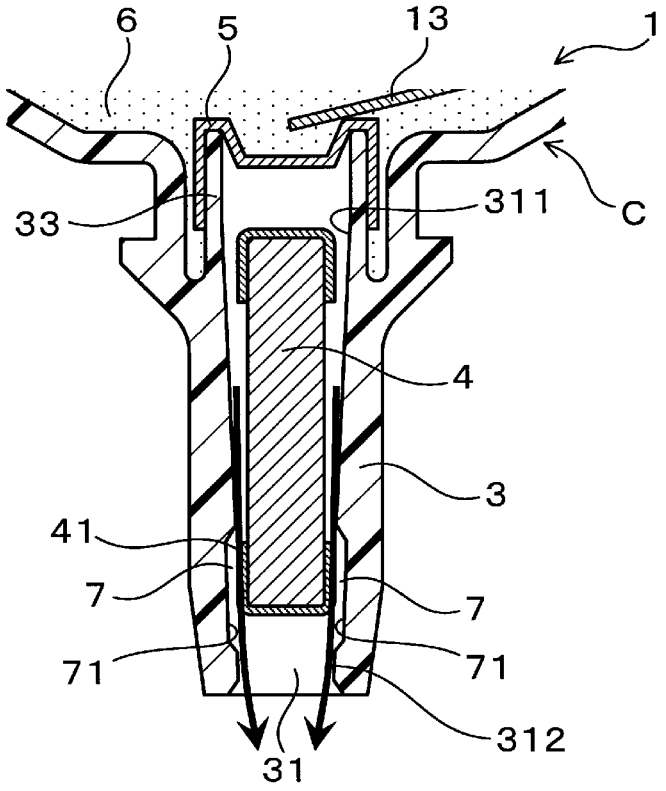
FIG. 8 is a view explaining action and effects provided by the structure of the vent part formed in the high voltage tower shaped part in the ignition coil according to the first exemplary embodiment of the present invention.

FIG. 8 is a view explaining action and effects provided by the improved structure of the vent parts 7 formed in the high voltage tower shaped part 3 in the ignition coil 1 according to the first exemplary embodiment of the present invention. As shown in FIG. 8, in the improved structure of the ignition coil 1 according to the first exemplary embodiment, the vent parts 7 are formed in the tower through hole 31, i.e. formed on the inner peripheral surface of the high voltage tower shaped part 3. That is, through the vent parts 7, the gap or the chamber formed at the proximal end part of the tower through hole 31 communicates with the gap or the chamber formed at the distal end part of the tower through hole 31 even if the resistance member 4 is located at the distal end part of the tower through hole 31.

Figure 9:
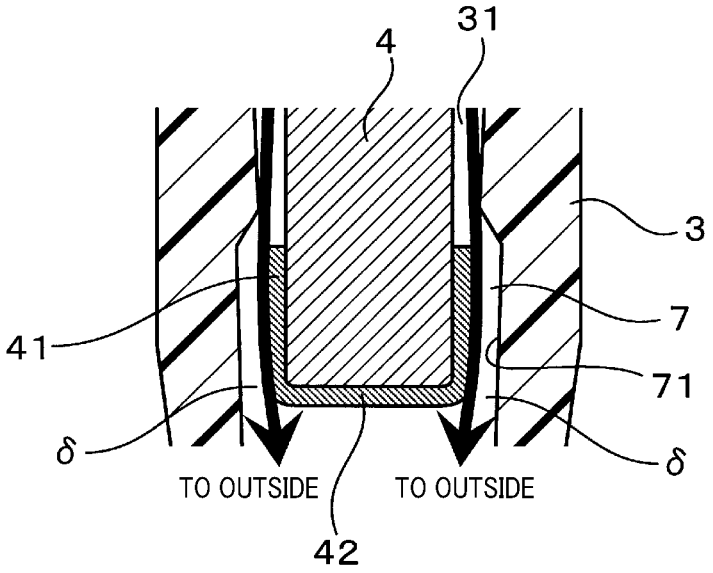
FIG. 9 is a part enlarged view showing a cross section of the high voltage tower shaped part so as to explain action and effects provided by the vent parts formed in the high voltage tower shaped part of the ignition coil according to the first exemplary embodiment of the present invention.

FIG. 9 is a part enlarged view showing a cross section of the high voltage tower shaped part 3 so as to explain action and effects provided by the vent parts 7 formed in the high voltage tower shaped part 3 of the ignition coil 1 according to the first exemplary embodiment of the present invention. As shown in FIG. 9, the improved structure of the ignition coil 1 according to the first exemplary embodiment makes it possible to release the inside air at the proximal end part of the tower through hole 31 to the outside of the high voltage tower shaped part 3 through a clearance δ (or a gap) as the vent parts 7 during the suction step (1) shown in FIG. 5. This makes it possible to avoid the force F from being generated, and the high voltage cap 5 from coming out during the suction step (1) shown in FIG. 5. As a result, because no gap is generated between the high voltage cap 5 and the inner cylindrical part 33, it is possible to avoid a part of the resin composition 60 injected during the resin injection step (2) shown in FIG. 5 from leaking As previously described in detail, the improved structure of the ignition coil 1 according to the first exemplary embodiment can be applied to the suction step (1) shown in FIG. 5 in production of producing the ignition coil 1. However, the concept of the present invention is not limited by this. It is possible to apply the concept of the present invention to the manufacture using a pressure impregnation step. This case makes it possible to have the same effects of the first exemplary embodiment. That is, it is possible to suppress the force F pushing the high voltage cap 5 from being generated by air compressed in the inside of the tower through hole 31 when the inside of the tower through hole 31 is switched from the pressure state to a usual atmospheric pressure state.

Figures 10A, 10B, 10C:
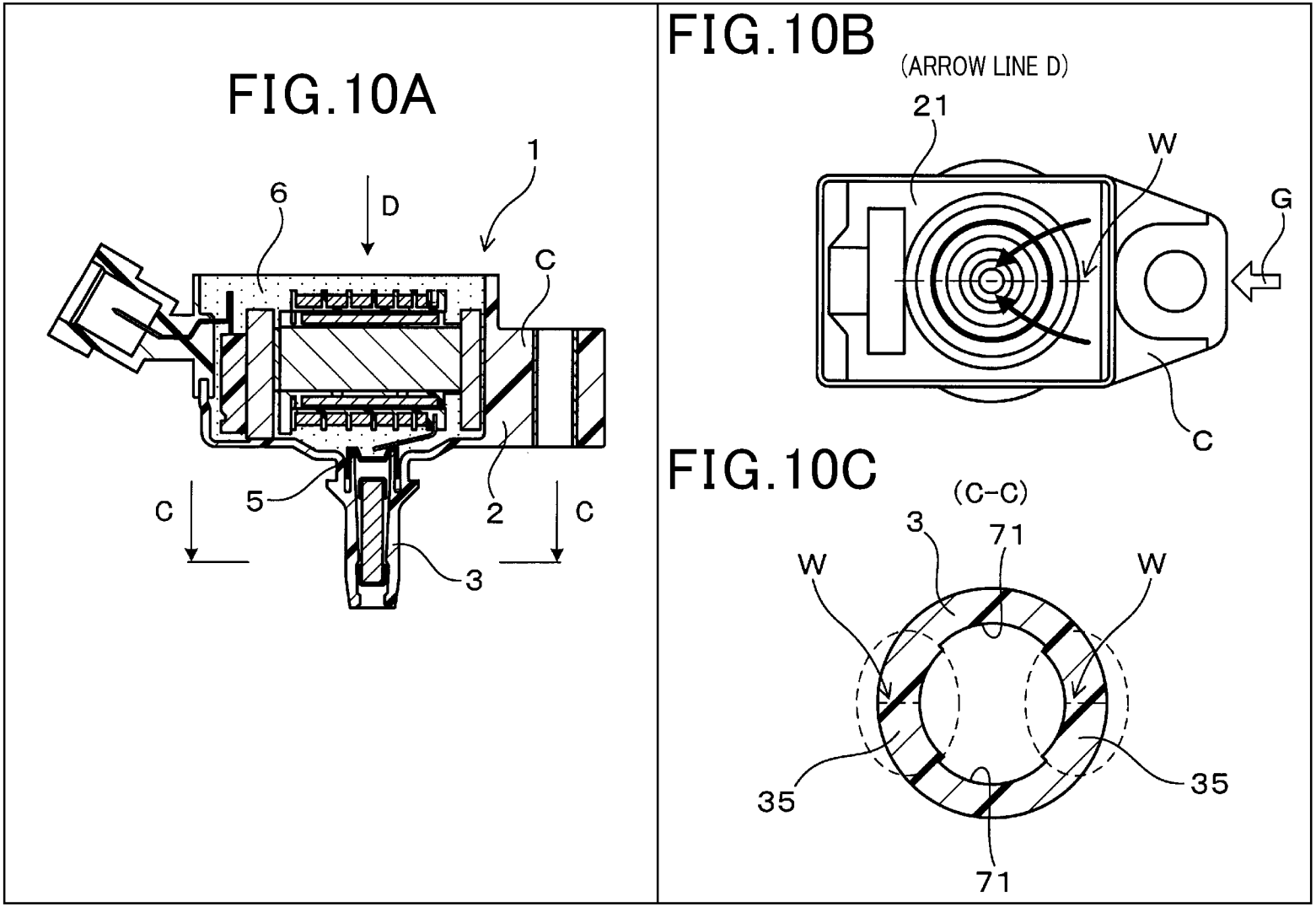
FIG. 10A is a view showing a cross section of the ignition coil according to the first exemplary embodiment of the present invention shown in FIG. 1.
FIG. 10B is a view showing a cross section along the arrow line D in a coil casing C in the ignition coil according to the first exemplary embodiment of the present invention.
FIG. 10C is a view showing a cross section along the arrow line C-C in the high voltage tower shaped part in the ignition coil according to the first exemplary embodiment of the present invention.

FIG. 10A is a view showing a cross section of the ignition coil 1 according to the first exemplary embodiment of the present invention shown in FIG. 1. FIG. 10B is a view showing a cross section along the arrow line D in the coil casing C in the ignition coil 1 according to the first exemplary embodiment. FIG. 10C is a view showing a cross section along the arrow line C-C (see FIG. 10A) in the high voltage tower shaped part 3 in the ignition coil 1 according to the first exemplary embodiment.

FIG. 10B shows the accommodating part 21 in the coil casing C before the coil unit U is accommodated therein. As shown in FIG. 10B and FIG. 10C, Weld parts W are formed in the coil casing C. That is, the weld parts W have welds which have been formed during the injection molding of thermoplastic resin.

In general, with the coil casing C as an injection molded product, fragile portions called "welds" are almost always formed near those portions in a mold where molten resin of thermoplastic resin is branched at the gate position G, and flows meet (designated by the bold arrows shown in FIG. 10B) in a metal die. Near welds, V-shaped grooves called "weld lines" may be formed due to adhesion failure. These result in a poor appearance, as well as adversely affecting strength and toughness due to stress concentrations (resulting from the notch effect), and so on.

Accordingly, it is preferable to form the vent parts 7 apart from the weld parts W in the high voltage tower shaped part 3 as shown in FIG. 10C.

In the improved structure of the ignition coil 1 according to the first exemplary embodiment, a pair of the vent parts 7 are formed at the locations facing from each other. Further, the thick parts 35 having a constant thickness are formed facing from each other between the grooves 71 as the vent parts 7. Accordingly, it is preferable to form the weld parts W passing through in the thick parts 35 in the radial direction which is perpendicular to the axial direction X.

Figure 11:
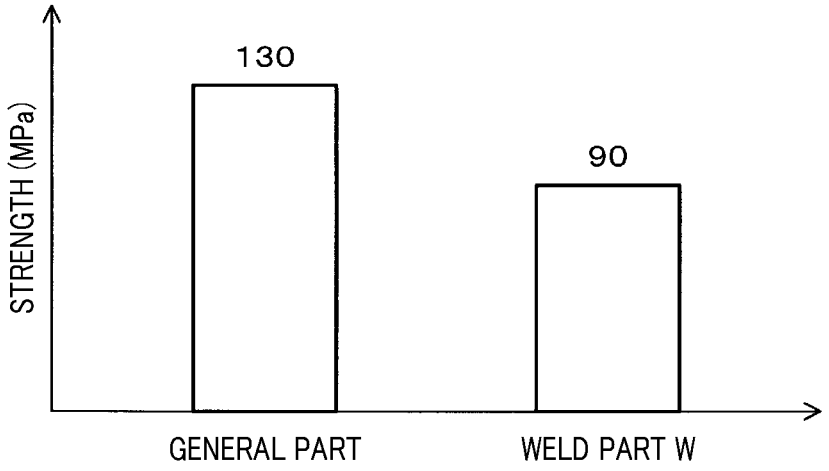
FIG. 11 is a bar graph showing a relationship in strength (MPa) between a general part and a weld part in the high voltage tower shaped part in the ignition coil according to a comparative example.
Figure 12:
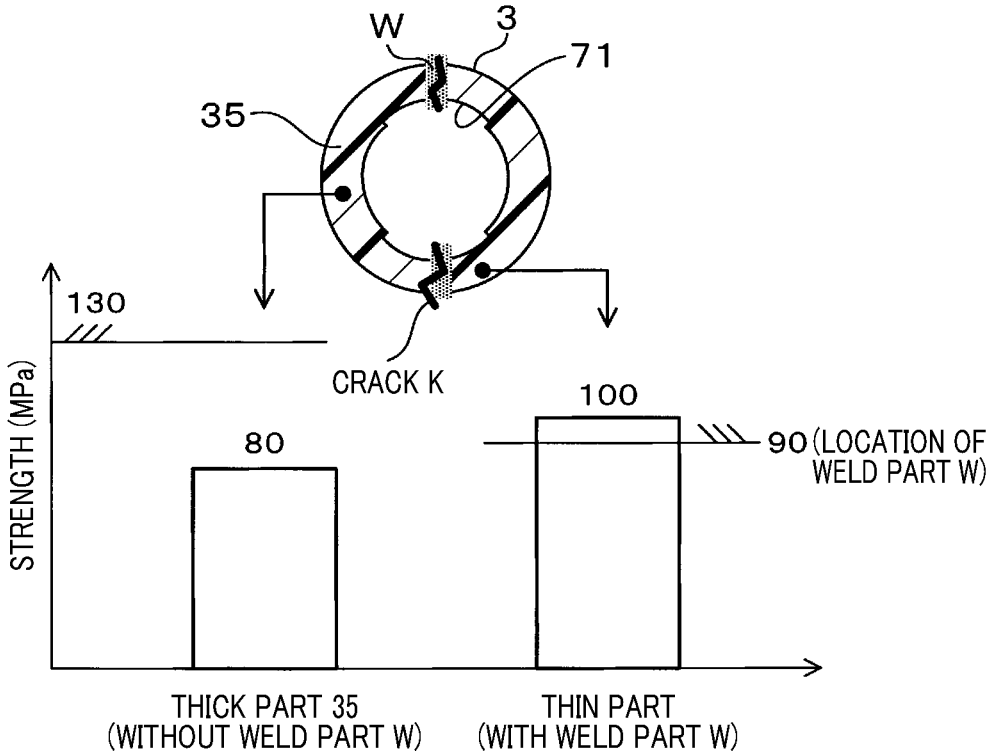
FIG. 12 is a bar graph showing a relationship in strength (MPa) between a thick part and a thin part, where the thin part is formed at a location of the weld part in the high voltage tower shaped part in the ignition coil according to a comparative example.

FIG. 11 is a bar graph showing a relationship in strength (MPa) between the general part and the weld part W in the high voltage tower shaped part 3 in the ignition coil 1 according to a comparative example. FIG. 12 is a bar graph showing a relationship in strength (MPa) between the thick part and a thin part, where the thin part is formed at a location of the weld part in the high voltage tower shaped part in the ignition coil according to a comparative example.

As shown in FIG. 11, when PBT (polybutylene terephthalate) is used as resin material, the weld parts W have a strength (for example, approximately 90 MPa) which is lower by approximately 30 percentages than the strength (for example, approximately 100 MPa) of the general part (excepting the weld parts W). Further, as shown in FIG. 12, when the weld parts W are formed at the thin parts in which the grooves 71 are formed, the stress (for example, 80 MPa) generated in the thick parts 35 becomes lower than the allowable stress (for example, 130 MPa) based on material strength of the general part. The stress in the thick part in which the grooves 71 are formed becomes higher than allowable stress (for example, 90 MPa) based on material strength of the weld parts W. This often generates cracks K shown in FIG. 12.

Figure 13:
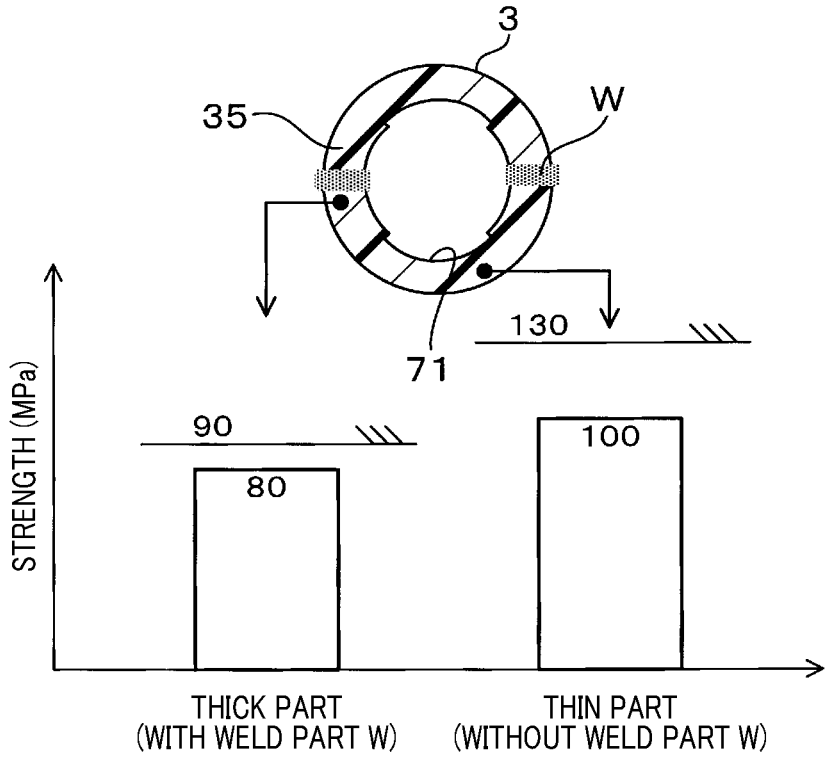
FIG. 13 is a bar graph showing a relationship in strength (MPa) between the thick part and the thin part, where the thick part is formed at the location of the weld part in the high voltage tower shaped part in the ignition coil according to the first exemplary embodiment of the present invention.

FIG. 13 is a bar graph showing a relationship in strength (MPa) between the thick part 35 and the thin part, where the thick part is formed at the location of the weld part in the high voltage tower shaped part in the ignition coil according to the first exemplary embodiment of the present invention.

As shown in FIG. 13, when the weld parts W are formed at the thick parts 35, the stress (for example, 80 MPa) in the thick parts 35 with the weld parts W becomes lower than the permitted stress value (i.e. 90 MPa) which has been determined based on the material strength of the material forming the weld parts W. Further, the stress (for example, 100 MPa) in the thin parts 35 with the grooves 71 becomes lower than the permitted stress value (i.e. 130 MPa) which has been determined based on the material strength of the material forming the general part. This structure shown in FIG. 13 makes it possible to reduce a difference in material strength between the thick part 35 and the thin part (as the general part), and to prevent cracks from being generated.

It is preferable to form the weld parts W at locations in which no groove 71 is formed when the high voltage tower shaped part has the structure according to the first modification shown in FIG. 4A to the fifth modification shown in FIG. 5E.

Second Exemplary Embodiment

A description will be given of the ignition coil 1 according to the second exemplary embodiment with reference to FIG. 14A, FIG. 14B, FIG. 14C to FIG. 17A to FIG. 17F.

Figure 14A:
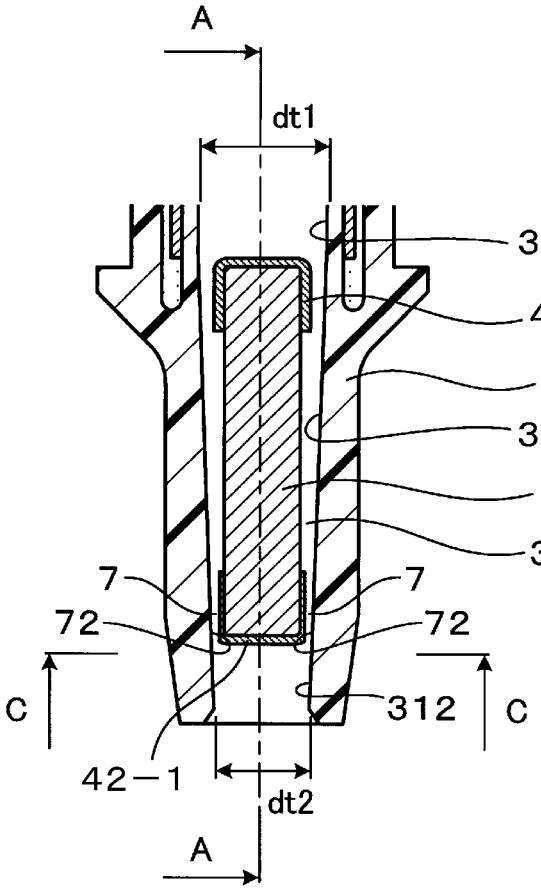
FIG. 14A is a view showing an enlarged cross section of the high voltage tower shaped part in the ignition coil for an internal combustion engine according to a second exemplary embodiment of the present invention.

FIG. 14A is a view showing an enlarged cross section of the high voltage tower shaped part 3 in the ignition coil 1 for an internal combustion engine according to the second exemplary embodiment of the present invention.

In the structure of the ignition coil 1 according to the first exemplary embodiment previously described, the vent parts 7 are formed by the grooves 71 formed in the tower through hole 31, i.e. on the inner peripheral surface of the high voltage tower shaped part 3.

However, the concept of the present invention is not limited by the structure of the ignition coil 1 according to the first exemplary embodiment.

As shown in FIG. 14A, the ignition coil 1 according to the second exemplary embodiment has the structure in which the vent parts 7 are formed between the outer peripheral surface of a conductive cap 41-1 and the tapered hole part 341. The conductive cap 41-1 is fitted to the distal end part of the resistance member 4. In other words, the vent parts 7 are formed by the cut parts 72, i.e. formed between the outer peripheral part of the conductive cap 41-1 and the inner peripheral surface of the tapered hole part 341 (i.e. the inner peripheral surface of the high voltage tower shaped part 3).

The same components between the first exemplary embodiment and the second exemplary embodiment will be referred with the same reference numbers and characters and the explanation of these same components is omitted for brevity.

Cut parts 72 are formed on the outer peripheral surface of the conductive cap 41-1 which is fitted only to the distal end part of the resistance member 4. Each of the cut parts 72 has been cut in the axial direction X, (i.e. along the longitudinal direction of the resistance member 4) on the outer peripheral surface of the conductive cap 41-1.

The vent parts 7 are formed between the tapered hole part 341 and the cut parts 72 of the conductive cap 41-1. The cut part 72 has a length in the axial direction X which is equal to the length in the axial direction of the conductive cap 41-1. The distal end part and proximal end part of each of the vent parts 7 correspond to the respective distal end part and proximal end part of the conductive cap 41-1.

When the resistance member 4 is located at the distal end part of the tapered hole part 341, i.e. in the tower through hole 31, the distal end part 312 communicates with the proximal end part of the tapered hole part 341 through the vent parts 7.

Figure 14B:
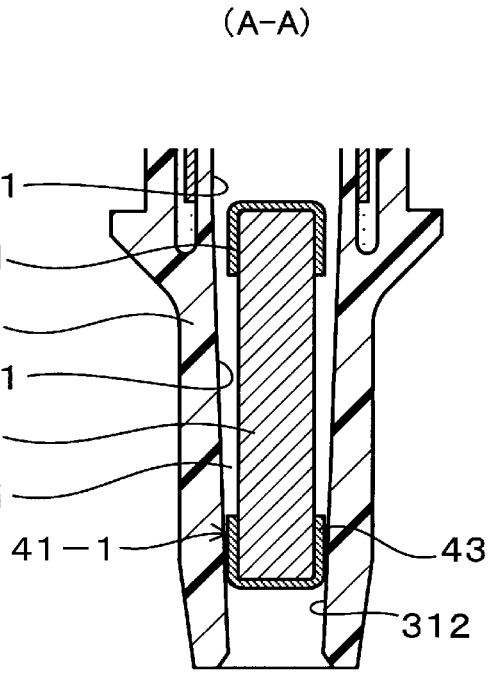
FIG. 14B is a view showing a cross section of the high voltage tower shaped part along the arrow line A-A shown in FIG. 14A.
Figure 14C:
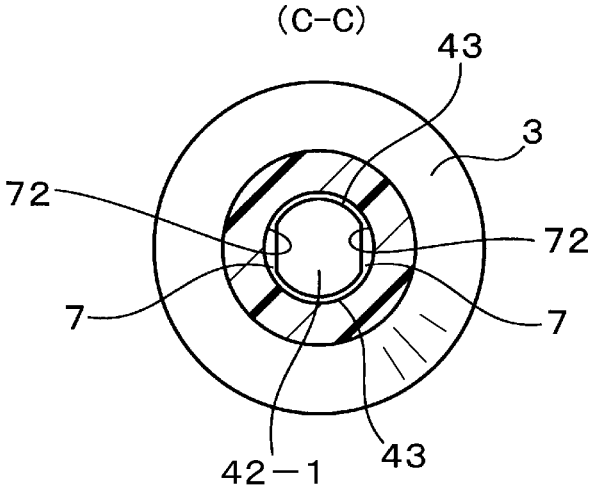
FIG. 14C is a view showing a cross section of the high voltage tower shaped part along the arrow line C-C shown in FIG. 14A.

FIG. 14B is a view showing a cross section of the high voltage tower shaped part 3 along the arrow line A-A shown in FIG. 14A. FIG. 14C is a view showing a cross section of the high voltage tower shaped part 3 along the arrow line C-C shown in FIG. 14A.

As shown in FIG. 14C, the cut parts 72*a* are formed at two locations, in symmetry facing each other, on the outer peripheral surface of the conductive cap 41-1. Each of the cut parts 72 has a straight outline in a cross section, which is perpendicular to the axial direction X. The vent part 7 formed between the cut part 72 and the tapered hole part 341, i.e. the inner peripheral surface of the high voltage tower shaped part 3 has a crescent-shaped cross section.

As shown in FIG. 14B and FIG. 14C, the thick parts 43 having a constant thickness are also formed in symmetry facing each other adjacent to the cut parts 72. Each of the cut parts 72 has a width which is approximately equal to the width of each of the thick parts 43.

FIG. 14B shows a cross section along the line C-C shown in FIG. 14A. As shown in FIG. 14B, the resistance member 4 is supported in the tower through hole 31, i.e. the tapered hole part 341 so that the thick parts 43 of the conductive cap 41-1 is fitted to the tapered hole part 341. This prevents the resistance member 4 from coming out from the high voltage tower shaped part 3 in the ignition coil 1.

Figure 15:
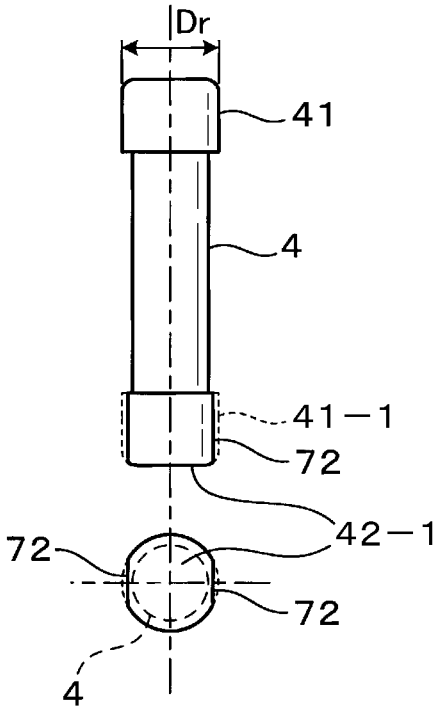
FIG. 15 is a view showing a front view and a plan view of cut parts as the vent parts formed in the high voltage tower shaped part in the ignition coil according to the second exemplary embodiment of the present invention.

FIG. 15 is a view showing a front view and a plan view of the cut part 72 as the vent part 7 formed in the high voltage tower shaped part 3 of the ignition coil 1 according to the second exemplary embodiment of the present invention.

As shown in FIG. 5, the resistance member 41 has a maximum outer diameter at the conductive cap 41 fitted to the proximal end part of the resistance member 4. Further, the resistance member 41 has the maximum outer diameter at the thick part 43 of the conductive cap 41-1 fitted to the distal end part of the resistance member 4.

Similar to the relationship of Ds<dt2<Dr<dt1 explained in the first exemplary embodiment, the structure of the according to the second exemplary embodiment has the same relationship of Ds<dt2<Dr<dt1 between Dr, dt1, dt2 and Ds, where d1 is the inner diameter of the proximal end part 311 of the tower through hole 31, d2 is the inner diameter of the distal end part 312 of the tower through hole 31, Dr is the outer diameter of the maximum outer diameter part of the resistance member 4, and Ds is the outer diameter at the proximal end part of the coil spring 17 (see FIG. 2).

Figure 16:
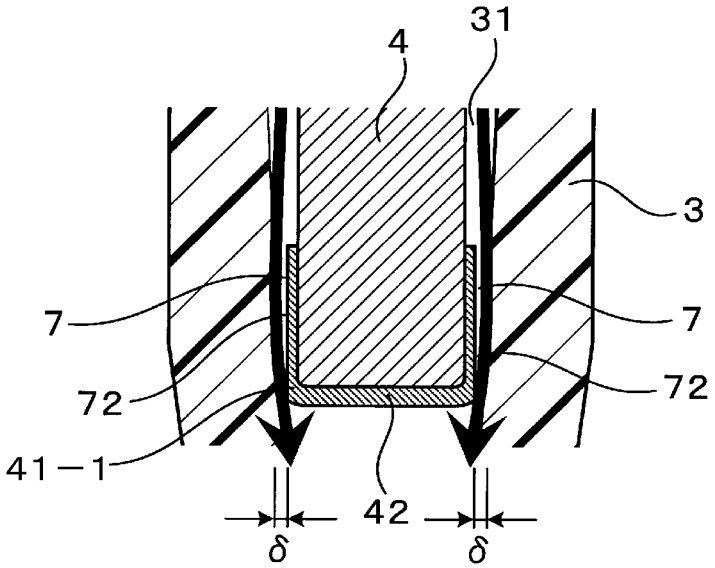
FIG. 16 is a part enlarged view showing a cross section of the high voltage tower shaped part having the cut parts in the ignition coil according to the second exemplary embodiment of the present invention.

FIG. 16 is a part enlarged view showing a cross section of the high voltage tower shaped part 3 having the cut parts 72 in the ignition coil according to the second exemplary embodiment of the present invention. As shown in FIG. 16, under the state in which the resistance member 4 is located at the maximum distal end part of the tower through hole 31, the proximal end part of the tower through hole 31 communicates with the distal end part of the tower through hole 31 through the vent parts 7. That is, through the vent parts 7, the gap or the chamber formed at the proximal end part of the tower through hole 31 communicates with the gap or the chamber formed at the distal end part of the tower through hole 31 even if the resistance member 4 is located at the distal end part of the tower through hole 31.

Similar to the improved structure of the ignition coil 1 according to the first exemplary embodiment, the improved structure of the ignition coil 1 according to the second exemplary embodiment makes it possible to release the inside air at the proximal end part of the tower through hole 31 to the outside of the high voltage tower shaped part 3 through the clearance δ (or the gap) as the vent parts 7 during the suction step (1) (see FIG. 5). This makes it possible to avoid the force F from being generated, and the high voltage cap 5 (see FIG. 8) from coming out from the tower through hole 31 during the suction step (1). As a result, because no gap is generated between the high voltage cap 5 and the inner cylindrical part 33, it is possible to avoid the resin composition 60 injected in the resin injection step (2) (see FIG. 5) from leaking The concept of the present invention is not limited by the shape and the location of the vent parts 7. It is not necessary for the resistance member 4 to have the conductive caps 41, 41-1. That is, it is possible to change the shape on the outer peripheral surface at the distal end part of the resistance member 4 so as to form the vent parts 7 between the outer peripheral surface of the resistance member 4 and the inner peripheral surface of the high voltage tower shaped part 3.

FIG. 17A to FIG. 17F are views showing a cross section of the outer peripheral surface of the resistance member 4, with which the vent parts having a shape according to sixth to eleventh modifications are formed at the inner peripheral side of the high voltage tower shaped part 3 of the ignition coil 1 according to the second exemplary embodiment.

Figure 17A:
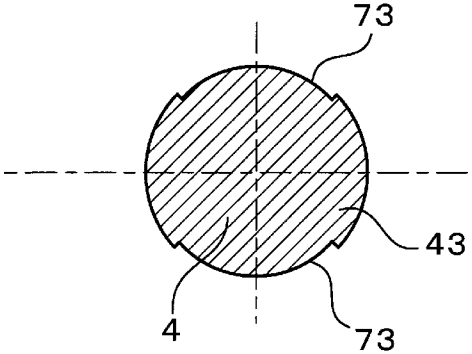
FIG. 17A is a view showing a cross section of the outer peripheral surface of the resistance member, with which vent parts having a shape according to a sixth modification are formed at the inner peripheral side of the high voltage tower shaped part of the ignition coil according to the second exemplary embodiment.

For example, in the sixth modification shown in FIG. 17A, it is acceptable to form a pair of outer peripheral grooves 73 having a constant width and a constant depth facing each other at two locations on the outer peripheral surface of the resistance member 4 instead using the cut parts 72.

Figure 17B:
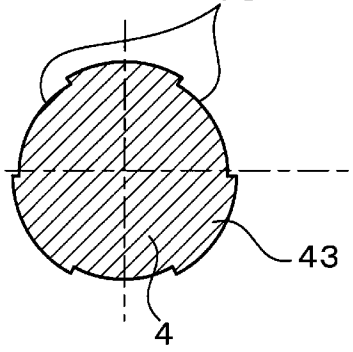
FIG. 17B is a view showing a cross section of the outer peripheral surface of the resistance member, with which vent parts having a shape according to a seventh modification are formed at the inner peripheral side of the high voltage tower shaped part of the ignition coil according to the second exemplary embodiment.
Figure 17C:
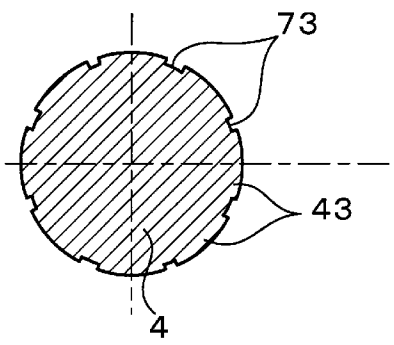
FIG. 17C is a view showing a cross section of the resistance member forming the vent part having a shape as an eighth modification, formed at the inner peripheral side of the high voltage tower shaped part of the ignition coil according to the second exemplary embodiment.
Figure 17D:
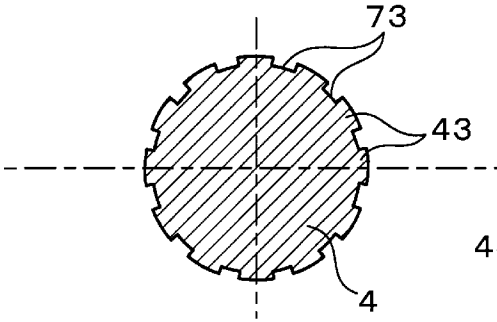
FIG. 17D is a view showing a cross section of the resistance member forming the vent part having a shape as a ninth modification, formed at the inner peripheral side of the high voltage tower shaped part of the ignition coil according to the second exemplary embodiment.

Further, it is acceptable to form three or more outer peripheral grooves 73, for example, one of:

(a) three outer peripheral grooves 73 at three locations according to the seventh modification shown in FIG. 17B;

(b) eight outer peripheral grooves 73 at eight locations according to the eighth modification shown in FIG. 17C; and (c) twelve outer peripheral grooves 73 at twelve locations according to the ninth modification shown in FIG. 17D, on the outer peripheral surface of the resistance member 4 instead using the cut parts 72.

In the seventh to ninth modifications shown in FIG. 17B to FIG. 17D, the thick parts 43 are formed between the adjacent outer peripheral grooves 73, and supported in the tower through hole 31 of the high voltage tower 3.

Figure 17E:
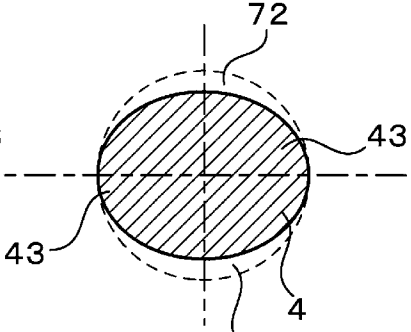
FIG. 17E is a view showing a cross section of the resistance member forming the vent part having a shape as a tenth modification, formed at the inner peripheral side of the high voltage tower shaped part of the ignition coil according to the second exemplary embodiment.

Still further, in the tenth modification shown in FIG. 17E, it is acceptable to form a pair of the outer peripheral grooves 73 of an arc-shaped outline having a constant width and a constant depth facing each other at two locations on the outer peripheral surface of the resistance member 4 instead using the cut parts 72. This tenth modification increases a circumferential width of each cut part 72. In this structure shown in FIG. 17E, an outer peripheral outline becomes an elliptical shape (see FIG. 17E) and a long diameter part of the elliptical shape becomes the maximum diameter part of the resistance member 4.

Figure 17F:
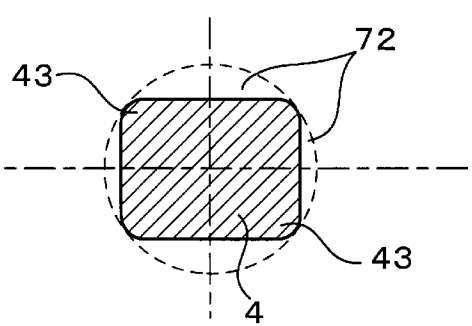
FIG. 17F is a view showing a cross section of the resistance member forming the vent part having a shape as an eleventh modification, formed at the inner peripheral side of the high voltage tower shaped part of the ignition coil according to the second exemplary embodiment.

Still further, in the twelfth modification shown in FIG. 17F, it is acceptable to form the cut parts 72 having a straight outline at four locations on the outer peripheral edges of the conductive cap 41, and to round each of the four corners of the conductive cap 41. In this structure shown in FIG. 17F, the thick parts 43 having the maximum diameter part of the resistance member 4 are formed on the diagonal lines of the resistance member 4.

In the first exemplary embodiment and the second exemplary embodiment, it is sufficient for the vent parts 7 to have a size capable of preventing the high voltage cap 5 from coming out from the tower through hole 31 during the suction step (1) in the resin sealing process (see FIG. 5). That is, it is preferable for each of the vent parts 7 to satisfy the following equation (1):

$$S/\sqrt[3]{(V)} \geq 0.006 \text{ (mm)} \quad (1)$$

where S indicates a cross sectional area of each vent part 7, which is perpendicular to the axial direction X of the tower through hole 31, located at an opening part formed at the distal end part of the tower through hole 31, and V indicates an inside volume of a proximal end chamber formed at the proximal end part in the tower through hole 31.

Figure 18:
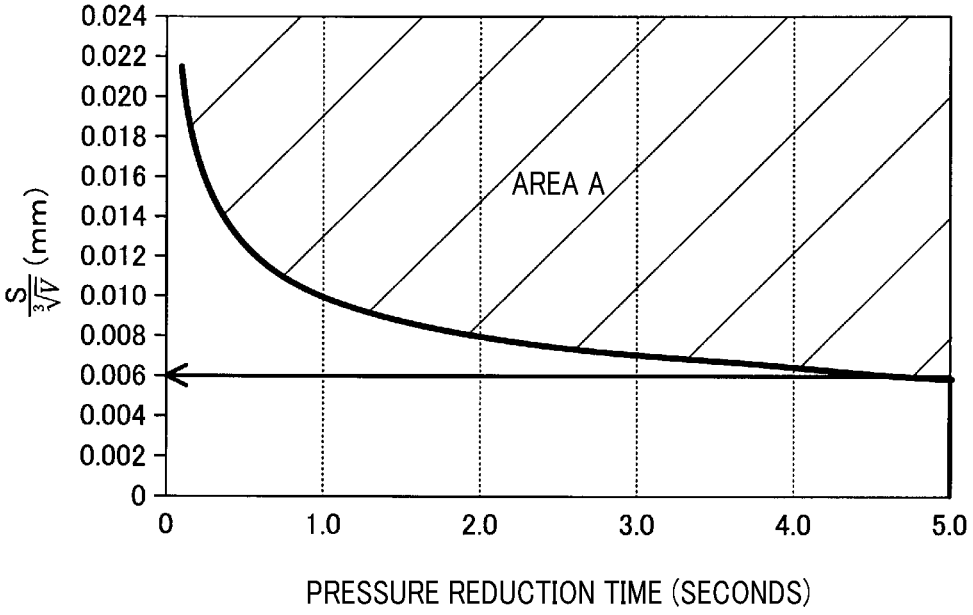
FIG. 18 is a view showing a relationship between a voltage reduction time (seconds) and an area in which the high voltage cap is moved during in production of the ignition coil according to the first and second exemplary embodiments of the present invention.

FIG. 18 is a view showing a relationship between a specific area A, a necessary clearance cross-sectional area S and a cube root ($\sqrt[3]{(V)}$) of a proximal-end inside volume V in the tower through hole 31 of the high voltage tower shaped part 3, where the high voltage cap 5 does not come out from the tower through hole 31 in the specific area A during the resin injection step (2) (see FIG. 5) when a pressure reduction time (seconds) is changed, and the necessary clearance cross-sectional area S represents an area of the clearance δ (or the gap as the vent parts 7) required to achieve the specific area A, and the pressure reduction time (seconds) indicates the time to reduce an internal pressure of the coil casing C during the suction step (1) and the resin sealing step (2) in the resin sealing process (see FIG. 5)

As previously explained, the necessary clearance cross-sectional area S represents a total sum of cross sectional areas in the clearance δ (or the gap) in a plurality of the vent parts 7 required to achieve the specific area A. This specific area A represents an area in which the force F to push up the high voltage cap 5 becomes less than the force F1 by which the high voltage terminal 13 completely presses the high voltage cap 5 and the high voltage cap 5 does not come out or move. It is sufficient to form the vent parts 7 so long as the inside air in the tower through hole 31 can smoothly flow therein and is discharged to the outside of the tower through hole 31. It is possible for each of the vent parts 7 to have a length in the axial direction X of 0.1 mm or more.

As shown in FIG. 18, in order to prevent the high voltage cap 5 from coming out from the tower through hole 31 during the suction step in the resin sealing process shown in FIG. 5 within the usual pressure reduction time (for example, within five seconds), it is sufficient for the value of $S/\sqrt[3]{(V)}$ to be not less than 0.006 (mm) as expressed by the equation (1) when each of the vent parts 7 has the length of not less than 0.1 mm in the axial direction X.

In other words, it is possible to prevent the high voltage cap 5 from coming out from the tower through hole 31 during the resin sealing process shown in FIG. 5 when the necessary clearance cross-sectional area S and the proximal-end inside volume V satisfy the following equation (2).

$$V \leq (S/0.006)^3 \text{ (mm}^3\text{)} \quad (2)$$

the relationship shown in FIG. 8, the shorter the pressure reduction time is reduced, the higher the pressure reduction speed increases, and as a result, the total time of performing the resin sealing process is reduced. This increase production cost of producing the ignition coil. It is preferable to form and arrange the vent parts 7 so that the value of $S/\sqrt[3]{(V)}$ becomes more than 0.006 (mm) as expressed by the equation (1) and within the specific area A according to the reduction of the pressure reduction time. For example, it is preferable to have the value of $S/\sqrt[3]{(V)}$ of not less than 0.0017 (mm) when the pressure reduction time is approximately 0.2 seconds (at which no leakage of the resin component from the coil casing C occurs). This condition makes it possible to drastically improve the production of the ignition coil while suppressing the high voltage cap 5 from coming out from the tower through hole 31 during the sealing resin sealing process shown in FIG. 5.

The concept of the present invention is not limited by the first and second exemplary embodiments and the modifications thereof previously described. For example, it is possible to apply the ignition coil 1 according to the present invention to gas engines for co-generation systems as combined heat and power systems, and various types internal combustion engines, etc.

While specific embodiments of the present invention have been described in detail, it will be appreciated by those skilled in the art that various modifications and alternatives to those details could be developed in light of the overall teachings of the disclosure. Accordingly, the particular arrangements disclosed are meant to be illustrative only and not limited to the scope of the present invention which is to be given the full breadth of the following claims and all equivalents thereof.

What is claimed is:

1. An ignition coil comprising:

a primary coil;

a secondary coil;

a coil casing comprising a casing body, an accommodating part formed in the casing body and a high voltage tower shaped part having a cylindrical shape, the accommodating part accommodating the primary coil and the secondary coil, the high voltage tower shaped part being formed projecting toward the outside of the casing body, a proximal end part of the high voltage tower shaped part being arranged in contact with a bottom surface of the accommodating part, a tower through hole being formed in the high voltage tower shaped part;

a resistance member having a cylindrical shape arranged as a movable member in the tower through hole;

a high voltage cap arranged at the proximal end part of the high voltage tower shaped part so as to prevent communication between the tower through hole and the accommodating part, and the high voltage cap electrically connecting the resistance member with a high voltage terminal connected to the secondary coil; and an insulation resin member with which the accommodating part is filled, wherein a proximal end part of the tower through hole has an inner diameter which is greater than an outer diameter of a maximum outer diameter part of the resistance member, and a distal end part of the tower through hole has an inner diameter which is less than the outer diameter of the maximum outer diameter part of the resistance member, and a vent part is formed, through which the proximal end part of the tower through hole communicates with the distal end part of the tower through hole when the resistance member is arranged at a maximum distal end position in the tower through hole.

2. The ignition coil for an internal combustion engine according to claim 1, wherein the vent part is a groove formed on an inner peripheral surface of the tower through hole along an axial direction of the tower through hole.

3. The ignition coil for an internal combustion engine according to claim 2, wherein the vent part is formed at two or more parts on the inner peripheral surface of the tower through hole along an axial direction (X) of the tower through hole.

4. The ignition coil for an internal combustion engine according to claim 3, wherein a cross sectional area of the vent part, which is perpendicular to the axial direction of the tower through hole, located at an opening part formed at the distal end part of the tower through hole, and an inside volume of a proximal end chamber formed at the proximal end part in the tower through hole, satisfy a relationship expressed by an equation of $S/\sqrt[3]{(V)} \geq 0.006$ (mm).

5. The ignition coil for an internal combustion engine according to claim 2, wherein a cross sectional area of the vent part, which is perpendicular to the axial direction of the tower through hole, located at an opening part formed at the distal end part of the tower through hole, and an inside volume of a proximal end chamber formed at the proximal end part in the tower through hole, satisfy a relationship expressed by an equation of $S/\sqrt[3]{(V)} \geq 0.006$ (mm).

6. The ignition coil for an internal combustion engine according to claim 1, wherein the vent part is one of a cut part and a groove formed on an outer peripheral surface of the resistance member along an axial direction of the resistance member.

7. The ignition coil for an internal combustion engine according to claim 6, wherein the vent part is formed at two or more parts on the outer peripheral surface of the resistance member along an axial direction (X) of the resistance member.

8. The ignition coil for an internal combustion engine according to claim 7, wherein a cross sectional area of the vent part, which is perpendicular to the axial direction of the tower through hole, located at an opening part formed at the distal end part of the tower through hole, and an inside volume of a proximal end chamber formed at the proximal end part in the tower through hole, satisfy a relationship expressed by an equation of $S/\sqrt[3]{(V)} \geq 0.006$ (mm).

9. The ignition coil for an internal combustion engine according to claim 6, wherein a cross sectional area of the vent part, which is perpendicular to the axial direction of the tower through hole, located at an opening part formed at the distal end part of the tower through hole, and an inside volume of a proximal end chamber formed at the proximal end part in the tower through hole, satisfy a relationship expressed by an equation of $S/\sqrt[3]{(V)} \geq 0.006$ (mm).

10. The ignition coil for an internal combustion engine according to claim 1, wherein a cross sectional area of the vent part, which is perpendicular to the axial direction of the tower through hole, located at an opening part formed at the distal end part of the tower through hole, and an inside volume of a proximal end chamber formed at the proximal end part in the tower through hole, satisfy a relationship expressed by an equation of $S/\sqrt[3]{(V)} \geq 0.006$ (mm).

* * * * *